US010396465B2

(12) United States Patent
Bailey et al.

(10) Patent No.: US 10,396,465 B2
(45) Date of Patent: Aug. 27, 2019

(54) NON-RMS AFFECTING MOUNTING SYSTEM FOR ANTENNA SYSTEMS

(71) Applicant: DISH Technologies L.L.C., Englewood, CO (US)

(72) Inventors: Matthew Bailey, Centennial, CO (US); William Roberts, Centennial, CO (US)

(73) Assignee: DISH Technologies L.L.C., Englewood, CO (US)

( * ) Notice: Subject to any disclaimer, the term of this patent is extended or adjusted under 35 U.S.C. 154(b) by 0 days.

(21) Appl. No.: 15/413,056

(22) Filed: Jan. 23, 2017

(65) Prior Publication Data

US 2018/0212332 A1 Jul. 26, 2018

(51) Int. Cl.

| | |
|---|---|
| ***H01Q 1/12*** | (2006.01) |
| ***H01Q 15/16*** | (2006.01) |
| ***H01Q 19/13*** | (2006.01) |
| ***H01Q 19/02*** | (2006.01) |

(52) U.S. Cl.
CPC ..... *H01Q 15/16* (2013.01); *H01Q 1/1207* (2013.01); *H01Q 1/1228* (2013.01); *H01Q 19/023* (2013.01); *H01Q 19/132* (2013.01)

(58) Field of Classification Search
CPC .... H01Q 15/16; H01Q 1/1207; H01Q 15/161; H01Q 19/193; H01Q 15/00; H01Q 1/1228; H01Q 19/023; H01Q 19/132
See application file for complete search history.

(56) References Cited

U.S. PATENT DOCUMENTS

| | | | | |
|---|---|---|---|---|
| 4,860,021 A * | 8/1989 | Kurosawa | ..... | H01Q 1/125 343/840 |
| 5,291,212 A * | 3/1994 | Cox | ..... | H01Q 15/168 343/840 |
| 2010/0289718 A1* | 11/2010 | Kang | ..... | H01Q 1/1207 343/882 |

* cited by examiner

*Primary Examiner* — Hai V Tran
*Assistant Examiner* — Michael M Bouizza
(74) *Attorney, Agent, or Firm* — Seed Intellectual Property Law Group LLP

(57) ABSTRACT

An antenna system includes technological improvements for achieving improved surface accuracy of an antenna reflector during manufacturing and assembly, as well as maintaining the surface accuracy in response to wear and tear on the reflector. The antenna system includes a reflector, a plurality of mounting tabs, and a backing structure. The reflector has a front reflecting curved surface, an outer rim, and a back surface. The plurality of mounting tabs are positioned and secured around the outer rim of the reflector. Each of the plurality of mounting tabs is independently flexible with respect to the outer rim. The backing structure has a central mount, a plurality of attachment arms, and a feed arm attachment. The plurality of attachment arms are secured to the outer rim of the reflector via the plurality of mounting tabs.

21 Claims, 6 Drawing Sheets

NON-RMS AFFECTING MOUNTING SYSTEM FOR ANTENNA SYSTEMS

BACKGROUND

Technical Field

The present disclosure relates generally to an antenna system, and more particularly, but not exclusively, to a mounting system for an antenna system.

Description of the Related Art

Content distributors deliver audiovisual content to users through a variety of different transmission systems, including satellite television transmission systems. Such transmission systems typically incorporate antenna systems to receive transmitted signals.

One important metric of an antenna system is the surface accuracy of the reflector. The surface accuracy can drastically affect the antenna gain if it is not held tightly to the nominal curve. One way to measure and quantify the surface accuracy of a reflector is by a calculation known as RMS (Root Mean Squared). Effectively, RMS is an average of all of the deviations on the surface of the reflector. Accordingly, a smaller RMS number for the reflector translates into a higher surface accuracy for the reflector, and the system achieving closer to its theoretical gain.

Traditionally, reflectors are connected to a mounting assembly with some type of backing structure. The manner in which backing structures are attached to reflectors may significantly affect reflector surface accuracy. Traditionally, backing structures are mounted with four bolts that come directly through the reflector face and mount to four tabs of the backing structure.

This effectively means that the reflector surface is sandwiched between the head of each bolt and the associated tab of the backing structure. When these bolts are tightened, the surface of the reflector is deformed to the shape of the backing structure, which is supposed to be the exact same curvature as the back of the reflector. However, the reality of traditional manufacturing processing is that the surface curvature of the backing structure is never held perfectly nominal to the curve of the design specification, just as the surface curvature of the reflector is not held perfectly nominal to the curve of the design specification. Accordingly, the result is that the surface of the reflector has one curve and the backing structure has another curve.

Therefore, the assembly of the reflector and the backing structure may result in a significant effect on the RMS of the reflector surface. Moreover, the assembly points (i.e., bolt holes) of traditional backing structures are all towards the middle portion of the reflector, which has been determined to be the portion of the reflector that contributes the most to the gain achieved by the antenna system. There is a continuing need to reduce or eliminate negative effects of the backing structure on the RMS of the reflector. It is with respect to these and other considerations that the embodiments described herein have been made.

Notably, all of the subject matter discussed in this section is not necessarily prior art and should not be assumed to be prior art merely as a result of its discussion in this section. Accordingly, any recognition of problems in the prior art discussed in this section or associated with such subject matter should not be treated as prior art unless expressly stated to be prior art. Instead, the discussion of any subject matter in this section should be treated as part of the identification of the technological problem to be overcome, which in and of itself may also be inventive.

BRIEF SUMMARY

The present disclosure is direct towards an antenna system for achieving and maintaining improved surface accuracy. In one embodiment, the present disclosure relates to a mounting assembly for an antenna system that achieves improved surface accuracy of an antenna reflector during manufacturing and assembly, as well as maintains the surface accuracy of the reflector when exposed to wear and tear from the weather.

The antenna system includes a reflector, a plurality of mounting tabs, and a backing structure. The reflector has a front reflecting curved surface, an outer rim, and a back surface. The plurality of mounting tabs are positioned around the outer rim of the reflector. Each of the plurality of mounting tabs is independently flexible with respect to the outer rim. The backing structure has a central mount, a plurality of attachment arms, and a feed arm attachment. The plurality of attachment arms are secured to the outer rim of the reflector via the plurality of mounting tabs.

In some embodiments, the antenna system employs a Non-RMS Affecting Mounting System and a reflector that is elliptical in shape. In another aspect of some embodiments, the reflector is a single piece of material. In still another aspect of some embodiments, the reflector is free from mounting holes. In yet another aspect of some embodiments, the antenna system further comprises a feed arm that secures to the feed arm attachment. Continuing, in another aspect of some embodiments, the antenna system further comprises an azimuth-elevation mount that secures to the central mount of the backing structure.

In at least one embodiment of the Non-RMS Affecting Mounting System for an antenna system, the plurality of attachment arms only secure to the outer rim of the reflector. In another aspect of at least one embodiment, the plurality of attachment arms comprises four attachment arms. In still another aspect, the reflector is elliptical and has a major axis and a minor axis, and two of the attachment arms are secured to the reflector on the major axis while two of the attachment arms are secured to the reflector on the minor axis. In yet another aspect, each of the plurality of mounting tabs rotatably flexes with respect to the outer rim of the reflector.

Another embodiment of an antenna system having improved surface accuracy after assembly is also disclosed. This antenna system includes a reflector, a plurality of mounting tabs, and a conical backing structure. The reflector has a front reflecting curved surface, an outer rim, and a back surface. The plurality of mounting tabs are positioned around the outer rim of the reflector. Each of the plurality of mounting tabs is independently flexible with respect to the outer rim. The conical backing structure has a central vertex, a conically extended surface that is bounded by a base rim, and a feed arm attachment. The base rim of the conical backing structure secures to the outer rim bracket via the plurality of mounting tabs.

These features with other technological improvements, which will become subsequently apparent, reside in the details of construction and operation as more fully described hereafter and claimed, reference being had to the accompanying drawings forming a part hereof.

BRIEF DESCRIPTION OF THE SEVERAL VIEWS OF THE DRAWINGS

The present application will be more fully understood by reference to the following figures, which are for illustrative purposes only. The figures are not necessarily drawn to scale and elements of similar structures or functions are generally represented by like reference numerals for illustrative purposes throughout the figures. The figures are only intended to facilitate the description of the various embodiments described herein. The figures do not describe every aspect of the teachings disclosed herein and do not limit the scope of the claims.

DETAILED DESCRIPTION

Figure 1A:
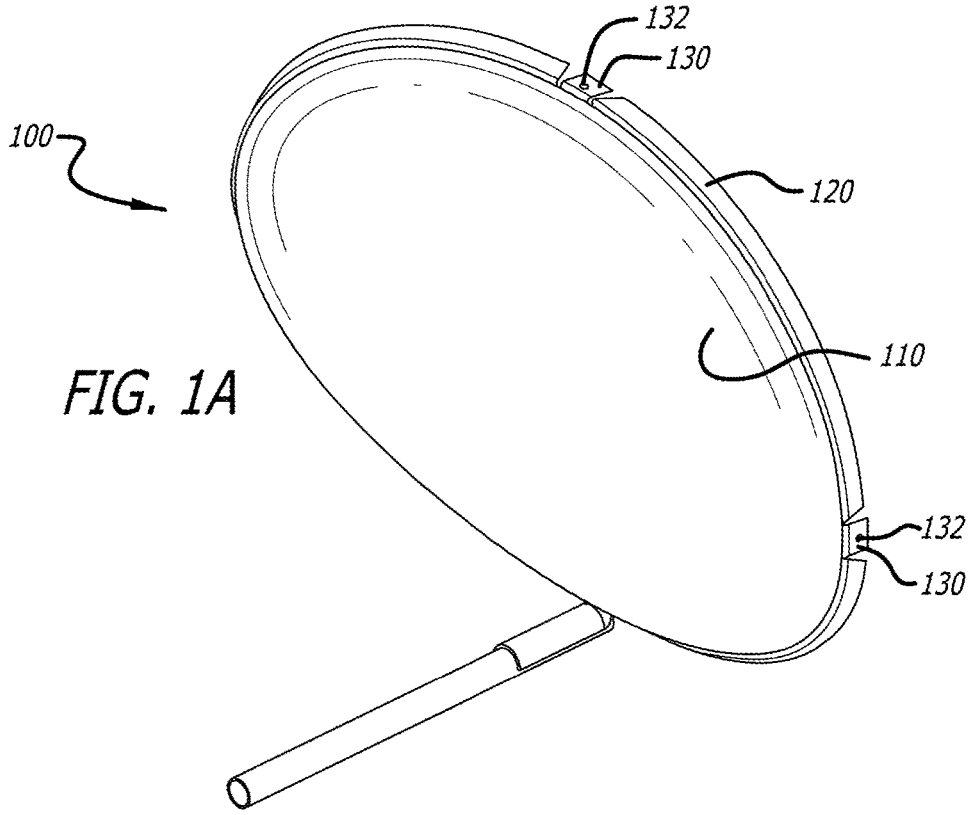
FIG. 1A illustrates a front isometric view of one embodiment of an antenna system with a non-RMS affecting backing structure.

Persons of ordinary skill in the art will understand that the present disclosure is illustrative only and not in any way limiting. Other embodiments and various combinations of the presently disclosed system and method readily suggest themselves to such skilled persons having the assistance of this disclosure.

Each of the features and teachings disclosed herein can be utilized separately or in conjunction with other features and teachings to provide an antenna system for Non-RMS Affecting Mounting System for an Antenna System. Representative examples utilizing many of these additional features and teachings, both separately and in combination, are described in further detail with reference to attached FIGS. 1A, 1B, and 3-7. This detailed description is intended to teach a person of skill in the art further details for practicing aspects of the present teachings, and is not intended to limit the scope of the claims. Therefore, combinations of features disclosed below in the detailed description may not be necessary to practice the teachings in the broadest sense, and are instead taught merely to describe particularly representative examples of the present teachings.

In the description below, for purposes of explanation only, specific nomenclature is set forth to provide a thorough understanding of the present system and method. However, it will be apparent to one skilled in the art that these specific details are not required to practice the teachings of the present system and method.

Throughout the specification, claims, and drawings, the following terms take the meaning explicitly associated herein, unless the context clearly dictates otherwise. The term "herein" refers to the specification, claims, and drawings associated with the current application. The phrases "in one embodiment," "in another embodiment," "in various embodiments," "in some embodiments," "in other embodiments," and other variations thereof refer to one or more features, structures, functions, limitations, or characteristics of the present disclosure, and are not limited to the same or different embodiments unless the context clearly dictates otherwise. As used herein, the term "or" is an inclusive "or" operator, and is equivalent to the phrases "A or B, or both" or "A or B or C, or any combination thereof," and lists with additional elements are similarly treated. The term "based on" is not exclusive and allows for being based on additional features, functions, aspects, or limitations not described, unless the context clearly dictates otherwise. In addition, throughout the specification, the meaning of "a," "an," and "the" include singular and plural references.

Moreover, the various features of the representative examples and the dependent claims may be combined in ways that are not specifically and explicitly enumerated in order to provide additional useful embodiments of the present teachings. It is also expressly noted that all value ranges or indications of groups of entities disclose every possible intermediate value or intermediate entity for the purpose of original disclosure, as well as for the purpose of restricting the claimed subject matter. It is also expressly noted that the dimensions and the shapes of the components shown in the figures are designed to help to understand how the present teachings are practiced, but not intended to limit the dimensions and the shapes shown in the examples.

Figure 2A:
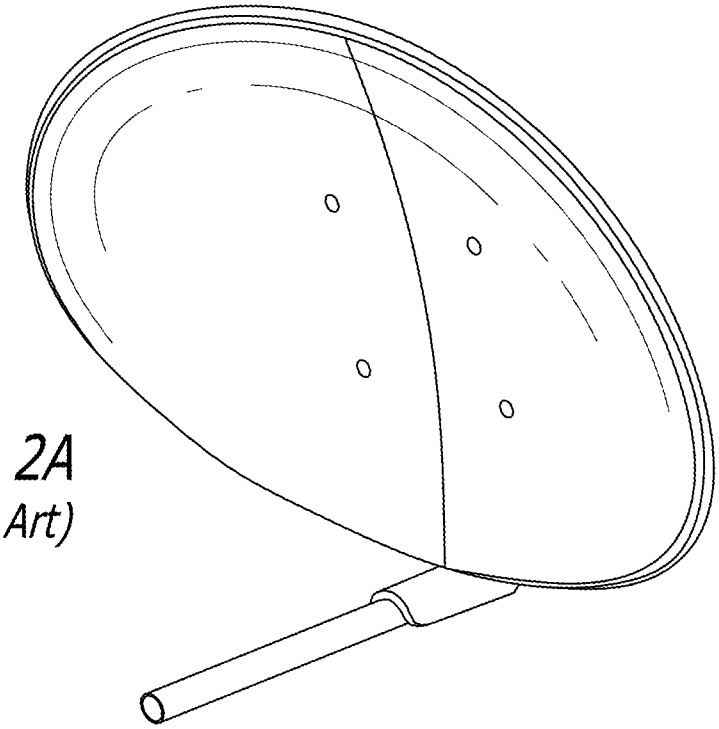
FIG. 2A (Prior Art)
FIG. 2A illustrates a front isometric view of an antenna system with a prior art backing structure.
Figure 2B:
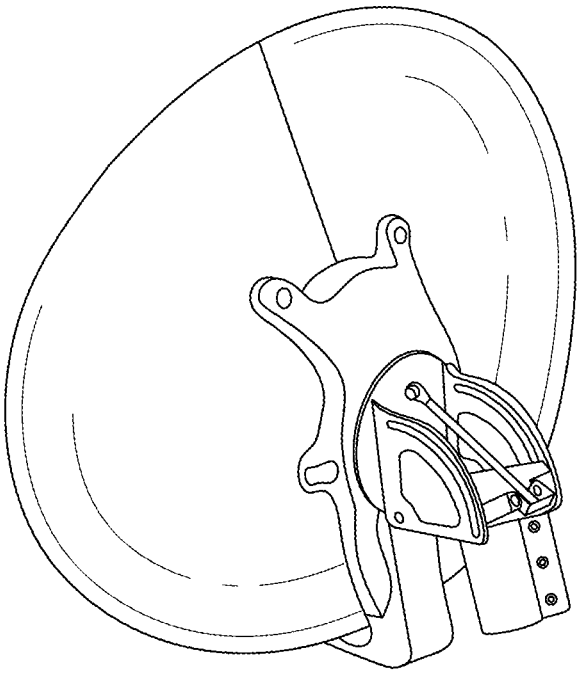
FIG. 2B (Prior Art)
FIG. 2B illustrates a back isometric view of an antenna system with a prior art backing structure.

The embodiments of the antenna system incorporate technical improvements to enhance reception. One such technical improvement is a Non-RMS Affecting Mounting System for an Antenna System 100. This Non-RMS Affecting Mounting System for an Antenna System 100 significantly reduces or eliminates negative effects of the backing structure on the RMS surface accuracy of an RMS Affecting antenna reflector 110 by moving the mounting points to the outer rim 120 of the reflector 110. As shown in FIGS. 2A and 2B, traditional (RMS Affecting) reflectors have mounting holes at or near the center of the reflector for attaching to a standard (RMS Affecting) backing structure.

Referring now to FIGS. 1A, 1B, 3, and 4, in at least one embodiment of the Non-RMS Affecting Mounting System for an Antenna System 100, there are a plurality of mounting tabs 130 on the outer rim 120 of the reflector 110 that can independently flex, if necessary, from the rest of the outer rim 120. Otherwise stated, the plurality of mounting tabs 130 may independently flex from the outer rim 120 of the reflector 110 so that the mounting tabs 130 do not impart any negative deflections on the outer rim 120 when secured to a backing structure, since the mounting tabs 130 may independently flex slightly to account for a non-perfect form in the backing structure.

As shown in FIGS. 1A, 1B, 3, and 4, in some embodiments, the mounting tabs 130 are part of a single sheet of material (e.g., galvanized steel, painting grey) and are formed by making cuts into the outer rim 120. The cuts into the outer rim 120 on either side of the mounting tabs 130 enable the mounting tabs 130 to independently flex due to the smaller connection area with the reflector 110 (i.e., width of the mounting tabs 130). In some embodiments, the mounting tabs 130 have a smaller width and in turn are more flexible with respect to the reflector 110, while in other embodiments, the mounting tabs 130 have a larger width and in turn are less flexible with respect to the reflector 110. In some embodiments, each mounting tab 130 contains a securing hole 132 for attaching to a mounting arm of a backing structure. In other embodiments, the mounting tabs 130 do not contain securing holes, but rather attach to a mounting arm of a backing structure using other known techniques.

Accordingly, in some embodiments, the plurality of flexible mounting tabs 130 does not impart any negative reflector surface deflections whatsoever. In other embodiments, the plurality of flexible mounting tabs 130 imparts only a significantly reduced amount of reflector surface deflections. In some embodiments, there are four mounting tabs 130. In other embodiments, there are a larger or smaller number of mounting tabs 130.

By implementing flexible mounting tabs 130 that secure the outer rim 120 of the reflector 110 to the backing structure, the Non-RMS Affecting Mounting System for an Antenna System 100 also eliminates the requirement of punching mounting holes into the center of the reflector 110. This removal of the mounting hole punching process provides a technological improvement, since this mounting hole punching can negatively affect RMS surface accuracy of an antenna reflector 110 (both due to the mounting holes themselves and due to the potential deforming of the reflector 110 during the hole punching process). Notably, the center of the reflector has been identified as contributing more significantly to overall antenna performance than the periphery of the reflector. Otherwise stated, the center of the reflector may be described as a "sweet spot" for signal reception performance. As such, the Non-RMS Affecting Mounting System for an Antenna System 100 provides a technological improvement by moving the connection points with the backing structure 140 to the outer rim 120 of the reflector 110. In this manner, the Non-RMS Affecting Mounting System for an Antenna System 100 eliminates mounting holes in the "sweet spot" of the reflector 110 and reduces potential defections at the "sweet spot" due to manufacturing, assembly, or wear and tear on the reflector 110.

Additionally, another technological improvement provided by the Non-RMS Affecting Mounting System for an Antenna System 100 is the removal of the mounting hole punching procedure, which simplifies and increases the efficiency of the antenna system manufacturing process. Furthermore, the mounting hole punching procedure may sometimes prove difficult to perform during the manufacturing/stamping process. As such, the elimination of this step through the use of the Non-RMS Affecting Mounting System for an Antenna System 100 is a technological improvement to the process.

Figure 3:
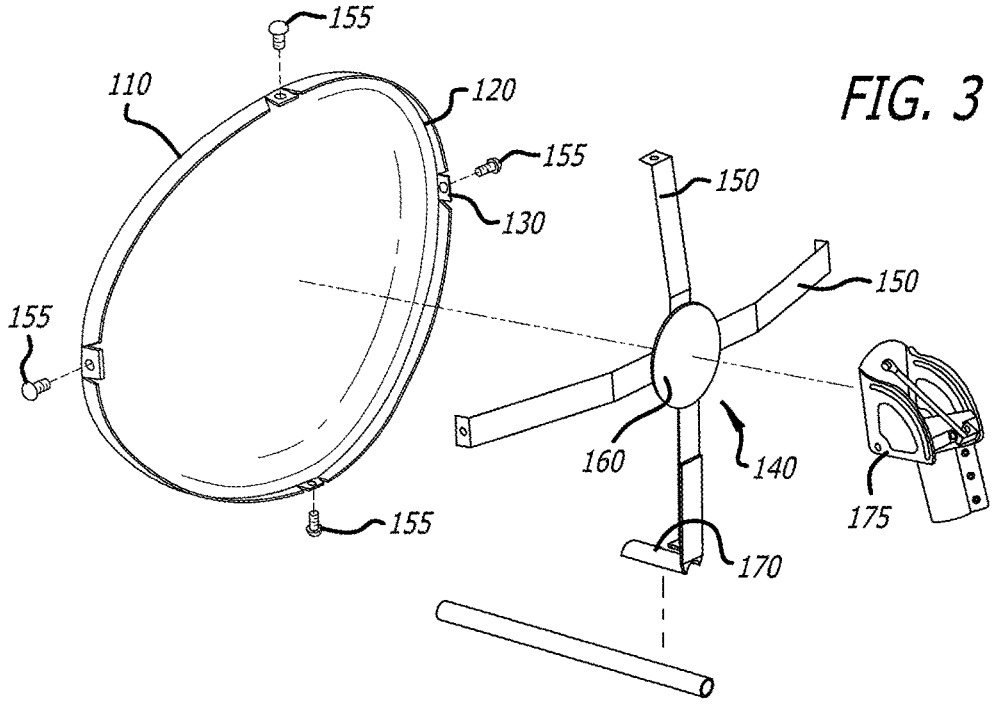
FIG. 3 illustrates a back exploded isometric view of one embodiment of an antenna system with a non-RMS affecting backing structure.
Figure 4:
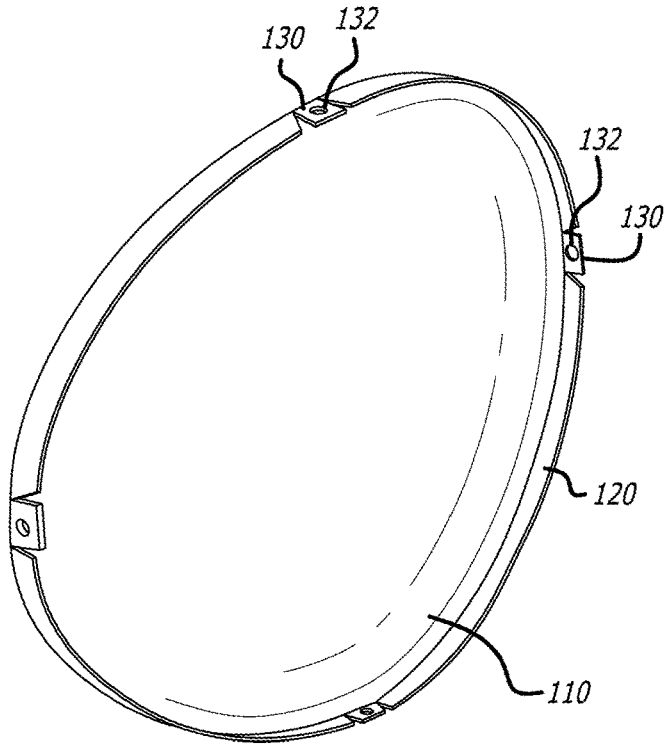
FIG. 4 illustrates a back isometric view of one embodiment a non-RMS affecting reflector for an antenna system.
Figure 5:
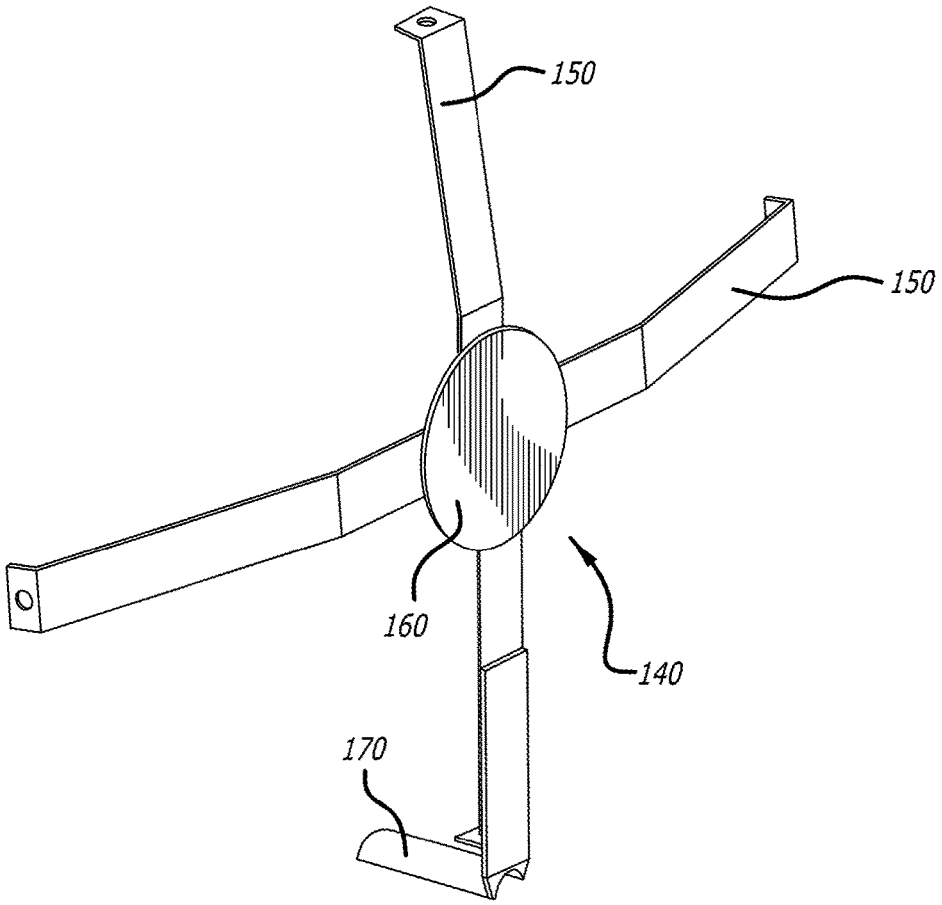
FIG. 5 illustrates a back isometric view of one embodiment a non-RMS affecting backing structure for an antenna system.

Referring now to FIGS. 3 and 5, in at least one embodiment, the Non-RMS Affecting Mounting System for an Antenna System 100 includes a Non-RMS Affecting backing structure 140 that has a plurality of mounting arms 150, a central plate 160, and a feed arm mounting bracket 170. In some embodiments, an azimuth-elevation mount 175 secures to the central plate 160 of the backing structure 140. The number of the plurality of flexible mounting tabs 130 matches the number of the plurality of mounting arms 150. In some embodiments, there are four mounting arms 150. In other embodiments, there are a larger or smaller number of mounting arms 150. In some embodiments the mounting arms 150 are produced using a stamping manufacturing process.

Figure 1B:
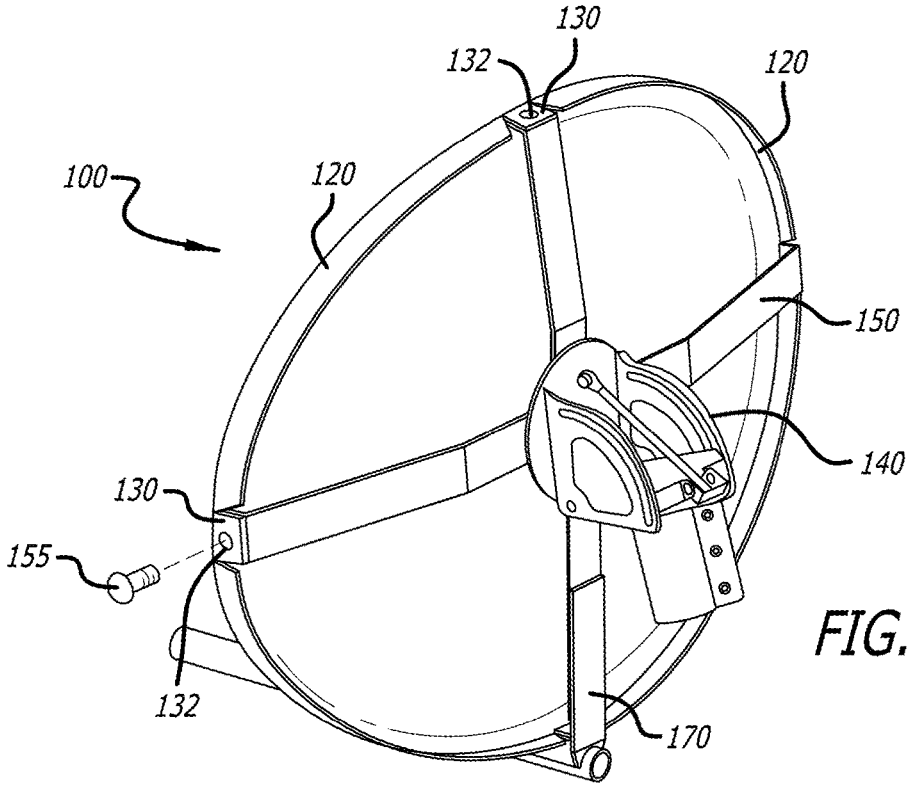
FIG. 1B illustrates a back isometric view of one embodiment of an antenna system with a non-RMS affecting backing structure.

FIG. 1B depicts fasteners 155 that extend through the securing holes 132 in the mounting tabs 130 to connect to each respective mounting arm 150, thereby connecting the Non-RMS Affecting reflector 110 to the Non-RMS Affecting backing structure 140. In some embodiments, the fasteners 155 that connect the mounting tabs 130 to the mounting arms 150 through the securing holes 132 are bolts. In other embodiments, the fasteners 155 that connect the mounting tabs 130 to the mounting arms 150 is selected from the group of a screw, rivet, weld, solder, epoxy, adhesive, flexible adhesive, or other acceptable connector.

In some embodiments of the Non-RMS Affecting Mounting System for an Antenna System 100, the plurality of mounting arms 150 of the Non-RMS Affecting backing structure 140 assist in maintaining the rigidity of the Non-RMS Affecting reflector 110 during wind events. In traditional antenna mounting systems (as shown in FIGS. 2A and 2B), during high wind events the winds may twist the reflector and cause deformation of the reflector around the central mounting point holes in the reflector. In embodiments of the Non-RMS Affecting Mounting System for an Antenna System 100 (as shown in FIGS. 1A, 1B, and 3-5), since the plurality of mounting arms 150 of the Non-RMS Affecting backing structure 140 support the Non-RMS Affecting reflector 110 at its periphery using the plurality of mounting tabs 130, the rigidity of the Non-RMS Affecting reflector 110 is better reinforced than in traditional central mounting systems that are attached at or near the center of the reflector.

Correspondingly, by implementing a Non-RMS Affecting backing structure 140 that supports the Non-RMS Affecting reflector 110 at its periphery, the Non-RMS Affecting Mounting System for an Antenna System 100 also eliminates the requirement of manufacturing traditional central mounting systems. In this manner, the plurality of mounting arms 150 of the Non-RMS Affecting backing structure 140 are also significantly simpler and more efficient to manufacture than traditional central mounting systems, since the plurality of mounting arms 150 have no complex forms to hold. Therefore, the Non-RMS Affecting Mounting System for an Antenna System 100 helps to eliminate (or at least significantly reduce) reflector surface deviations imparted by the backing structure, which in turn lowers the assembled RMS surface accuracy. This ensures that the antenna system is achieving the highest level of gain that it may achieve, which helps increase overall satellite signal reception capacity.

In one embodiment of the Non-RMS Affecting Mounting System for an Antenna System 100, the plurality of mounting arms 150 of the Non-RMS Affecting backing structure 140 are rotatable about the central plate 160, which enables the backing structure 140 to occupy less space during shipment (e.g., require less space on the technician's truck or in a shipping package). In some embodiments, the plurality of mounting arms 150 of the Non-RMS Affecting backing structure 140 are made out of bent sheet metal with only two simple bends in the mounting arms 150. In at least one embodiment, the central plate 160 disc is a stamped piece of metal that is easy to manufacture. Additionally, the feed arm mounting bracket 170 is a simple stamped piece of metal that is easy to manufacture. As such, the Non-RMS Affecting backing structure 140 of the Non-RMS Affecting Mounting System for an Antenna System 100 is significantly easier to manufacture than the traditional central mounting systems that are currently in use.

In contrast to traditional antenna mounting systems, the plurality of mounting arms 150 of the Non-RMS Affecting backing structure 140 being mounted to the outer rim 120 of the Non-RMS Affecting reflector 110 in the Non-RMS Affecting Mounting System for an Antenna System 100 ensure that imperfections (e.g., manufacturing deviations from design specifications) in the form of the backing structure do not impart negatively on the RMS surface accuracy of the reflector 110. Moreover, in contrast to traditional antenna mounting systems, the plurality of mounting arms 150 of the Non-RMS Affecting backing structure 140 being mounted to the outer rim 120 of the Non-RMS Affecting reflector 110 also helps to ensure that, during wind events, the reflector does not permanently deform around the mounting bolts at or near the center of the reflector, which is a current technical problem to be overcome. Such wind events may have a grave effect on the RMS surface accuracy of a reflector, especially in high wind speed scenarios.

Figure 6:
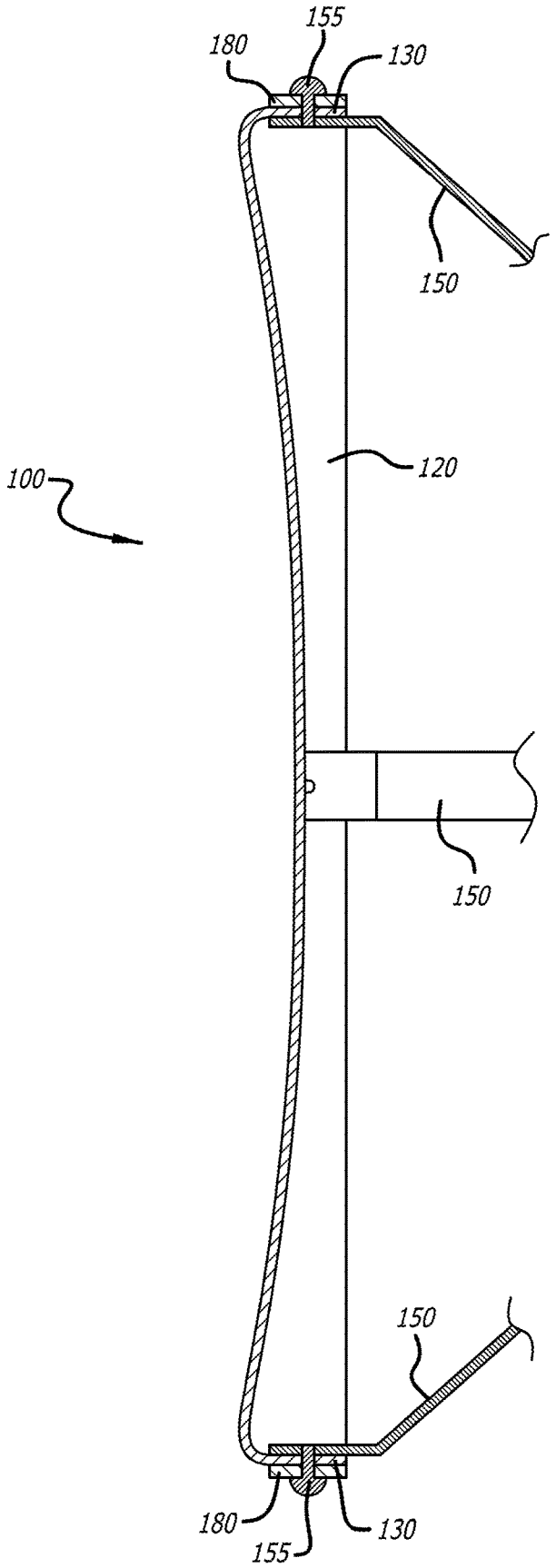
FIG. 6 illustrates a side cross-sectional view of one embodiment a non-RMS affecting backing structure for an antenna system with an additional periphery ring that supports the shape of the outer rim.

Referring now to FIG. 6, in another embodiment of the Non-RMS Affecting Mounting System for an Antenna System 100, the outer rim 120 of the Non-RMS Affecting reflector 110 includes a periphery ring 180 in an elliptical shape to support the shape of the reflector 110 and connect the Non-RMS Affecting reflector 110 to the Non-RMS Affecting backing structure 140. In some embodiments, the plurality of mounting tabs 130 connect the periphery ring 180 of the Non-RMS Affecting reflector 110 to the plurality of mounting arms 150 of the Non-RMS Affecting backing structure 140. In other embodiments, the periphery ring 180 of the Non-RMS Affecting reflector 110 connects to the plurality of mounting arms 150 of the Non-RMS Affecting backing structure 140 without the plurality of mounting tabs 130.

Figure 7:
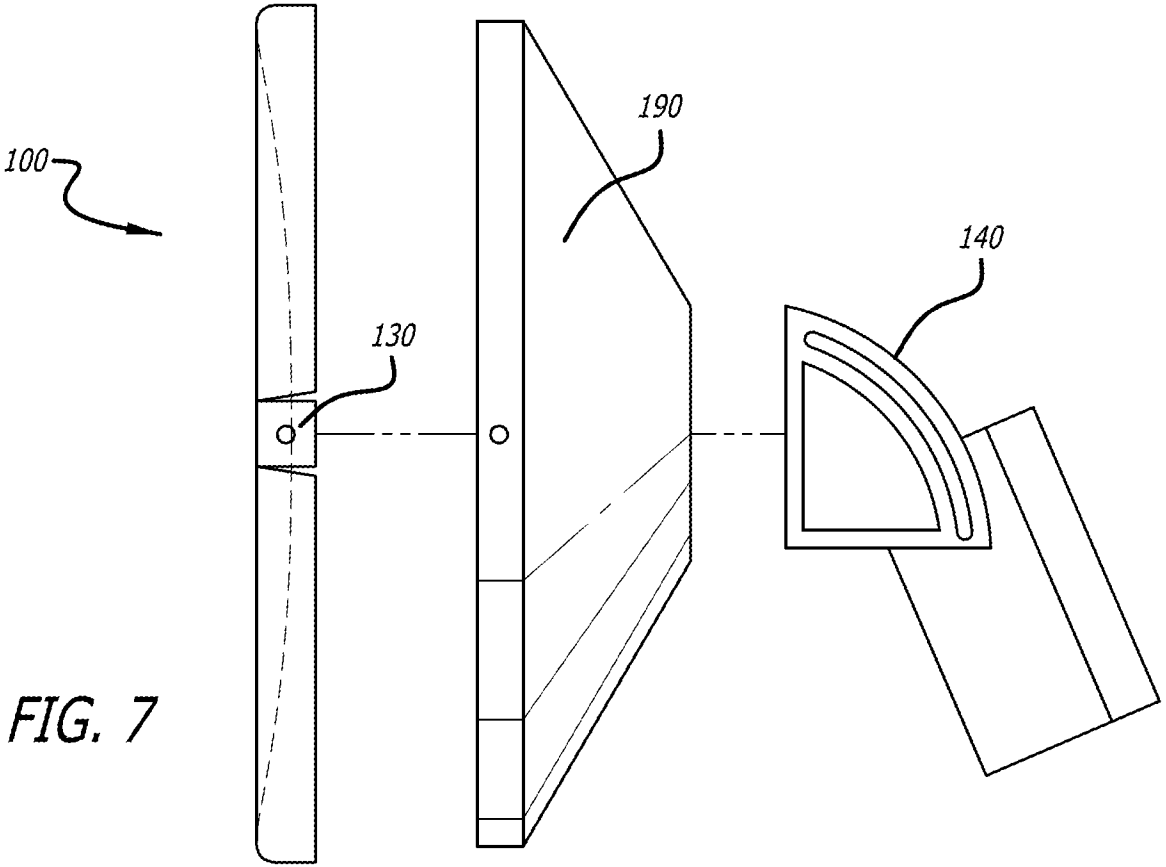
FIG. 7 illustrates a side view of one embodiment a non-RMS affecting backing structure for an antenna system with a hollow conical frustum that replaces the plurality of mounting arms.

Referring now to FIG. 7, in still another embodiment of the Non-RMS Affecting Mounting System for an Antenna System 100, the Non-RMS Affecting backing structure 140 employs a frusta-conical surface 190 having a base rim (instead of the plurality of mounting arms 150) to connect the outer rim 120 of the Non-RMS Affecting reflector 110 to the Non-RMS Affecting backing structure 140. Specifically, FIG. 7 illustrates one embodiment a Non-RMS Affecting Mounting System for an Antenna System 100 with a hollow conical frustum 190 that replaces the plurality of mounting arms (shown in FIGS. 1B, 3, and 5). In some embodiments, the plurality of mounting tabs 130 connect the outer rim 120 of the Non-RMS Affecting reflector 110 to the base rim of the Non-RMS Affecting backing structure 140. In other embodiments, the outer rim 120 of the Non-RMS Affecting reflector 110 connects to the base rim of the Non-RMS Affecting backing structure 140 without the plurality of mounting tabs 130.

The foregoing description, for purposes of explanation, uses specific nomenclature and formula to provide a thorough understanding of the disclosed embodiments. It should be apparent to those of skill in the art that the specific details are not required in order to practice the invention. The embodiments have been chosen and described to best explain the principles of the disclosed embodiments and its practical application, thereby enabling others of skill in the art to utilize the disclosed embodiments, and various embodiments with various modifications as are suited to the particular use contemplated. Thus, the foregoing disclosure is not intended to be exhaustive or to limit the invention to the precise forms disclosed, and those of skill in the art recognize that many modifications and variations are possible in view of the above teachings.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the breadth and scope of a disclosed embodiment should not be limited by any of the above-described exemplary embodiments, but should be defined only in accordance with the following claims and their equivalents.

The invention claimed is:

1. An antenna system having improved surface accuracy after assembly, the system comprising:

a reflector having a front reflecting curved surface, an outer rim, a back surface, and a plurality of mounting tabs positioned around the outer rim of the reflector, each of the plurality of mounting tabs being independently flexible with respect to the outer rim of the reflector;

a backing structure having a central mount, a plurality of attachment arms, and a feed arm attachment; and a plurality of fasteners that secure each of the plurality of attachment arms to the outer rim of the reflector via the plurality of mounting tabs to support the reflector.

2. The system of claim 1, wherein the reflector is elliptical.

3. The system of claim 1, wherein the reflector is a single piece of material.

4. The system of claim 1, wherein the reflector is free from holes.

5. The system of claim 1, further comprising a feed arm that secures to the feed arm attachment.

6. The system of claim 1, further comprising an azimuth-elevation mount that secures to the central mount of the backing structure.

7. The system of claim 1, wherein the plurality of attachment arms only secure to the outer rim of the reflector.

8. The system of claim 1, wherein the plurality of attachment arms comprise four attachment arms.

9. The system of claim 8, wherein the reflector is elliptical and has a major axis and a minor axis, and wherein two of the four attachment arms are secured to the reflector along the major axis and two of the four attachment arms are secured to the reflector along the minor axis.

10. The system of claim 1, wherein the plurality of mounting tabs are rotatably secured to the outer rim of the reflector.

11. An antenna system having improved surface accuracy after assembly, the system comprising:

a reflector having a front reflecting curved surface, an outer rim, a back surface, and a plurality of mounting tabs positioned around the outer rim of the reflector, each of the plurality of mounting tabs being independently flexible with respect to the outer rim of the reflector;

a backing structure having a plurality of attachment arms; and a plurality of fasteners that secure each of the plurality of attachment arms to the outer rim of the reflector via the plurality of mounting tabs to support the reflector.

12. The system of claim 11, wherein the reflector is elliptical.

13. The system of claim 11, wherein the reflector is a single piece of material.

14. The system of claim 11, wherein the reflector is free from holes.

15. The system of claim 11, further comprising a feed arm attachment and a feed arm that secures to the feed arm attachment.

16. The system of claim 11, further comprising an azimuth-elevation mount that secures to the central plate of the backing structure.

17. The system of claim 11, wherein the reflector includes a central region on the front reflecting curved surface inside of the outer rim, and wherein the plurality of attachment arms make no contact with the central region when the backing structure is secured to the reflector.

18. The system of claim 11, wherein the plurality of attachment arms comprise four attachment arms.

19. The system of claim 18, wherein the reflector is elliptical and has a major axis and a minor axis, and wherein two of the four attachment arms are secured to the reflector along the major axis and two of the four attachment arms are secured to the reflector along the minor axis.

20. The system of claim 11, wherein the plurality of mounting tabs are rotatably secured to the outer rim of the reflector.

21. An antenna system having improved surface accuracy after assembly, the system comprising:

a reflector having a front reflecting curved surface, an outer rim, a back surface, and a plurality of mounting tabs positioned around the outer rim of the reflector, each of the plurality of mounting tabs being independently flexible with respect to the outer rim of the reflector;

a conical backing structure having a central vertex, a conically extended surface that is bounded by a base rim, and a feed arm attachment, wherein the base rim of the conical backing structure secures to the outer rim of the reflector via the plurality of mounting tabs.

* * * * *